US007229246B2

(12) United States Patent
Ghasripoor et al.

(10) Patent No.: US 7,229,246 B2
(45) Date of Patent: Jun. 12, 2007

(54) COMPLIANT SEAL AND SYSTEM AND METHOD THEREOF

(75) Inventors: Farshad Ghasripoor, Scotia, NY (US); Shorya Awtar, Clifton Park, NY (US); Norman Arnold Turnquist, Sloansville, NY (US); Biao Fang, Clifton Park, NY (US); Carl Anthony Flecker, III, Loveland, OH (US); James William Stegmaier, West Chester, OH (US); Glenn Herbert Nichols, Mason, OH (US); James Charles Przytulski, Fairfield, OH (US); Kurt Grover Brink, Mason, OH (US); Richard Cohen Lykins, Kettering, OH (US); Jeffrey Reid Thyssen, Delmar, NY (US); Mahmut Faruk Aksit, Istanbul (TR)

(73) Assignee: General Electric Company, Niskayuna, NY (US)

( * ) Notice: Subject to any disclaimer, the term of this patent is extended or adjusted under 35 U.S.C. 154(b) by 106 days.

(21) Appl. No.: 10/955,079

(22) Filed: Sep. 30, 2004

(65) Prior Publication Data

US 2006/0067815 A1 Mar. 30, 2006

(51) Int. Cl.
*F01D 11/20* (2006.01)
*F04D 29/08* (2006.01)

(52) U.S. Cl. ..... 415/173.3; 277/413; 415/174.2

(58) Field of Classification Search ..... 415/173.1, 415/173.3, 170.1, 171.1, 173.4, 173.5, 173.6, 415/174.2, 174.4, 174.5; 277/411, 412, 413, 277/415, 416, 421, 422

See application file for complete search history.

(56) References Cited

U.S. PATENT DOCUMENTS

| | | | | |
|---|---|---|---|---|
| 4,295,786 | A | 10/1981 | Bill et al. | 415/174 |
| 5,002,288 | A | 3/1991 | Morrison et al. | |
| 5,344,284 | A | 9/1994 | Delvaux et al. | |
| 5,395,124 | A | 3/1995 | Brandon | 277/53 |
| 5,603,510 | A * | 2/1997 | Sanders | 415/173.3 |
| 6,250,641 | B1 | 6/2001 | Dinc et al. | |
| 6,502,823 | B1 | 1/2003 | Turnquist et al. | 277/355 |
| 6,572,115 | B1 * | 6/2003 | Sarshar et al. | 277/412 |
| 6,786,487 | B2 | 9/2004 | Dinc et al. | 277/355 |
| 2003/0080513 | A1 | 5/2003 | Kirby et al. | |
| 2004/0012149 | A1 * | 1/2004 | Laurello et al. | 277/355 |
| 2004/0188947 | A1 * | 9/2004 | Paprotna | 277/413 |

FOREIGN PATENT DOCUMENTS

JP 61152906 A * 7/1986

* cited by examiner

*Primary Examiner*—Richard A. Edgar
(74) *Attorney, Agent, or Firm*—Fletcher Yoder

(57) ABSTRACT

A compliant seal assembly for a rotating machine is provided. The seal assembly includes a static member, a movable member and a biasing member. The static member is rigidly fixed to the machine at its fore and aft ends. The movable portion has a first sealing surface configured to seal against a rotating member and a rear surface, which may be exposed to a fluid pressure to urge the first sealing surface toward a sealing position with the rotating member. The static and the movable members further include sealing surfaces at their fore, aft and end faces to seal against leakage of gas between the static and the movable members. The biasing member is configured to support the movable member on the static member and to urge the movable member away from the sealing position so as to reduce force on the rotating member during contact of the rotating member with the first sealing surface of the movable member.

25 Claims, 11 Drawing Sheets

COMPLIANT SEAL AND SYSTEM AND METHOD THEREOF

BACKGROUND

The invention relates generally to the field of rotating machines, and in particular to turbine engines. Specifically, embodiments of the present technique provide a compliant seal between rotating and static components in such machines.

A number of applications call for sealing arrangements between rotating and stationary components. Such seals may vary in construction, depending upon such factors as the environments in which they function, the fluids against which they form a seal, and the temperature ranges in which they are anticipated to operate. In turbine and similar applications, for example, seals are generally provided between the various stages of rotating components, such as turbine blades, and corresponding stationary structures, such as housings or shrouds within which the rotating components turn.

Efficiency and performance of gas and steam turbines are affected by clearances between rotating blade tips and the stationary shrouds, as well as between the nozzle tips and the rotor. In the design of gas and steam turbines, it is desirable to have a close tolerance between the tips of the rotating blades and the surrounding static shroud. In a turbine engine, the portion of the working fluid passing through the clearance between the tips of the rotating blades and the stationary shroud does no work on the blades, and leads to a reduced efficiency of the engine. Generally, the closer the shroud or stationary component surrounds the tips of the rotating blades, the greater is the efficiency of the turbine engine.

However, clearance dimensions between the rotating blade tips and the stationary shroud may vary at different times during the operation of the turbine engine. For example, the clearance decreases significantly due to dissimilar thermal growths, non-uniformity or transient motion between adjacent rotating and static components, causing interfacing surfaces to rub. Such a rub may lead to rapid wear of the blade and the stationary shroud, and may set up forced vibrations in the turbine engine. Wear on the shroud and the rotating blades is undesirable as it increases clearance dimensions and leads to a further loss in efficiency.

Prior methods to solve the above problem include using a seal on the stationary shroud surface, the sealing material being designed to be wearable or abradable with respect to the rotating blade rubbing against them. In such a system, a rub or contact of the blade tips with the stationary shroud causes the abradable shroud material to abrade or flake off. This avoids damage to the rotating components, and provides reduced clearances and thus better sealing as compared to a non-abradable system, in which large cold-built clearances have to be provided to prevent rubbing during transient conditions, such as dissimilar thermal growths between rotating and static components. However, this abradable system suffers from the disadvantage of reduced life of the sealing material. Also, previous abradable seals, even though various materials for the shroud have been proposed such as sintered metal, metal honeycombs and porous ceramics, have not provided a desirable compliance. Further, after a rub or a contact due to a transient condition, the gap or wear produced by the rub or contact is larger than the interference depth, due to tearing out, galling and spalling.

Accordingly, there is a need for a sealing technique to minimize the damage caused to the rotating and static components due to rubbing during transient periods, and to reduce vibration levels in the turbine engine caused by the same.

BRIEF DESCRIPTION

The present techniques provide a novel sealing approach designed to respond to such needs. In one aspect, a seal assembly for a rotating machine is provided. The seal assembly includes a static member, a movable member and a biasing member. The static member is rigidly fixed to the machine at its fore and aft ends. The movable portion has a first sealing surface configured to seal against a rotating member and a rear surface, which may be exposed to a fluid pressure to urge the first sealing surface toward a sealing position with the rotating member. The static and the movable members further include sealing surfaces at their fore, aft and end faces to seal against leakage of gas between the static and the movable members. The biasing member is configured to support the movable member on the static member and to urge the movable member away from the sealing position so as to reduce force on the rotating member during contact of the rotating member with the first sealing surface of the movable member.

In another aspect, a method for manufacturing a seal for a rotating machine is provided. In accordance with the method, a movable member is mounted on a static member. The movable member has sealing surfaces along fore, aft and end faces of the seal assembly, which are aligned with sealing surfaces provided on the static member along the fore, aft, and end faces. An opening is provided on the static member. The opening is configured to expose the movable member to a fluid pressure to urge the movable member toward a sealing position. A biasing member is disposed on the movable member to support the movable member on the static member and to urge the movable member away from the sealing position to reduce force on the movable member during a contact at the sealing position.

In yet another aspect, a method for sealing a gas path in a turbine is provided. In accordance with the method, a movable member, mounted on a static member, is urged toward a tip of a rotating turbine blade via a gas pressure applied to a rear surface of the movable member. The movable member is supported on the static member by a biasing member. The biasing member is preloaded to bias the movable member away from the turbine blade against a force resulting from the gas pressure to reduce force on the turbine blade during contact of the turbine blade with the movable member.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The following description presents a novel approach for sealing between rotating and static components in rotating machines. One example of a rotating machine is a turbine, which finds applications in aircraft engines, and industrial and marine power generation systems, to mention only a few. In accordance with certain embodiments of the present techniques, the shroud surrounding the rotating blades of the turbine includes a stationary portion, and a compliant portion. The compliant portion is capable of moving radially outward during contact or rub with the blades, thus reducing wear on the rotating blades as well as on the surrounding shroud.

Figure 1:
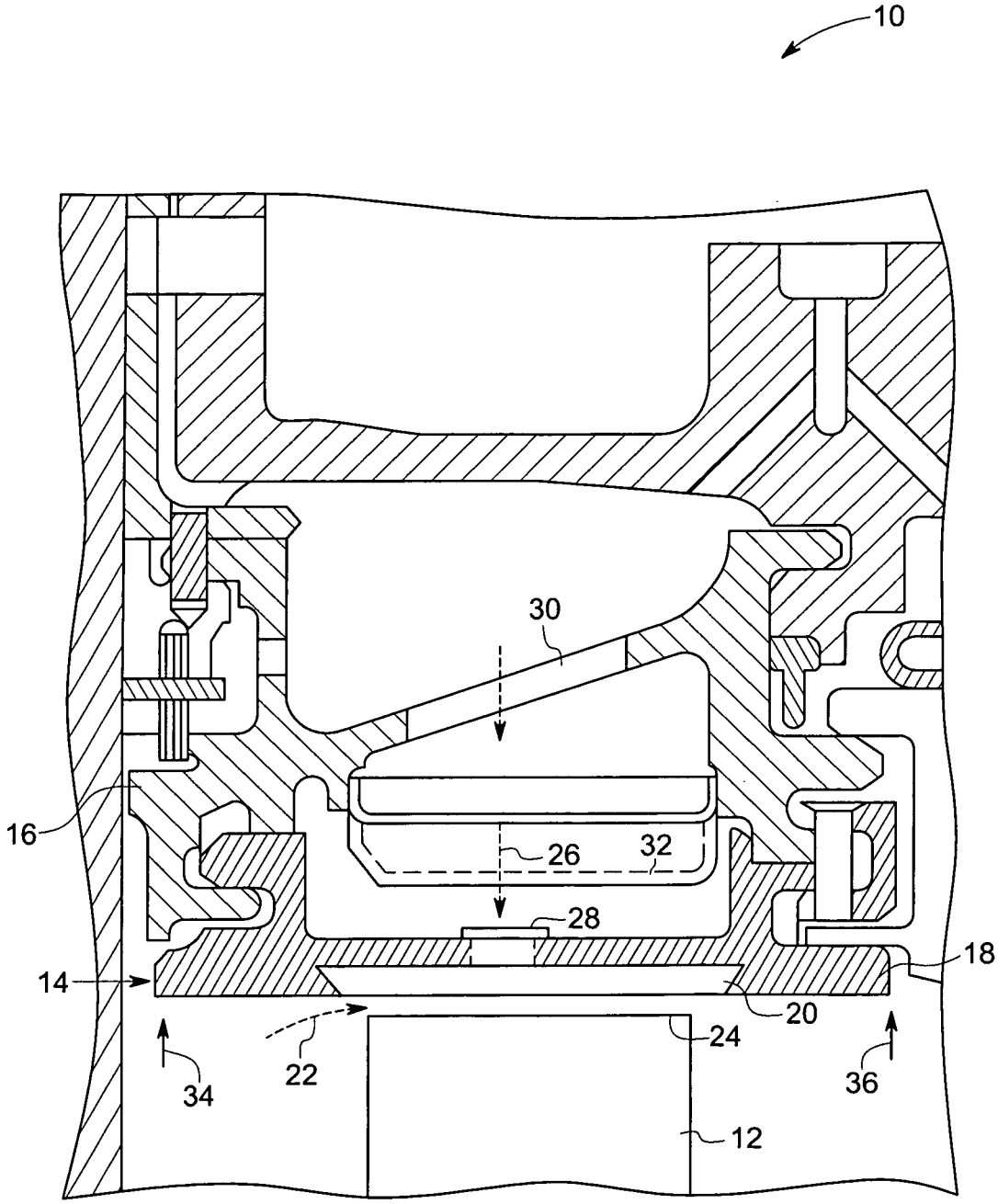
FIG. 1 is a cross sectional view of a portion of a turbine engine incorporating a compliant seal assembly in accordance with aspects of the present techniques.

Referring now to FIG. 1, there is illustrated an exemplary portion of a turbine, designated generally by the reference numeral 10. Turbine 10 includes multiple blades 12, mounted on a rotor (not shown). Blades 12 rotate inside a stationary housing or shroud assembly 14, which is mounted on to a hanger 16. In accordance with the embodiment illustrated, the shroud assembly 14 includes a static member 18, also referred to as a static shroud, which is rigidly fixed or hooked to the hanger 16, and a movable member 20, also referred to as a compliant shroud. In certain embodiments, the shroud assembly 14 is retrofitable in existing turbines with no modification or removal of the hanger 16. As will be described in great detail in the following sections, the static member 18 and the movable member 20 provide a compliant seal for a gas path 22 between the blades 12 and the shroud assembly 14.

The movable member 20 is biased toward a tip 24 of the rotating blade 12 by a fluid pressure, which in the illustrated embodiment is a pressure exerted by a cooling gas 26 on a rear surface 28 of the movable member. This fluid pressure is also referred to as back pressure. Although the illustrated embodiment shows a blade 12 with a bare tip 24, other embodiments may include blades that have a shrouded tip having outwardly extending continuous knife edges or rails, that mesh with inwardly extending knife edges or rails on the surrounding shroud. The cooling gas 26 enters the shroud assembly 14 via a hole 30 provided on the hanger 16, and may be directed toward the movable member 20 via baffles 32 or pores (not shown). The cooling gas 26 may then be directed toward a fore end 34 of the shroud assembly 14. This aids cooling the fore end 34, which is at a relatively higher temperature than an aft end 36. In the present description, the term fore end refers to the end from which the hot gas or working fluid flows on to the rotating blade, and the term aft end refers to the end to which the hot gas flows after doing work on the rotating assembly.

The present techniques incorporate back pressure of the cooling gas 26 to provide an increased resistance in the path 22 of the hot gas, thus creating a higher pressure differential of the hot gas between the fore and aft ends. This increases the work done on the rotating blade 12 by the hot gas, and hence improves turbine efficiency. Further, in accordance with the present techniques, the compliant seal assembly, including the static member 18 and the movable member 20 is configured to reduce reaction force on the blades 12, as well as on the shroud 16 during rubbing or interference of static and rotating components during certain transient periods.

Figure 2:
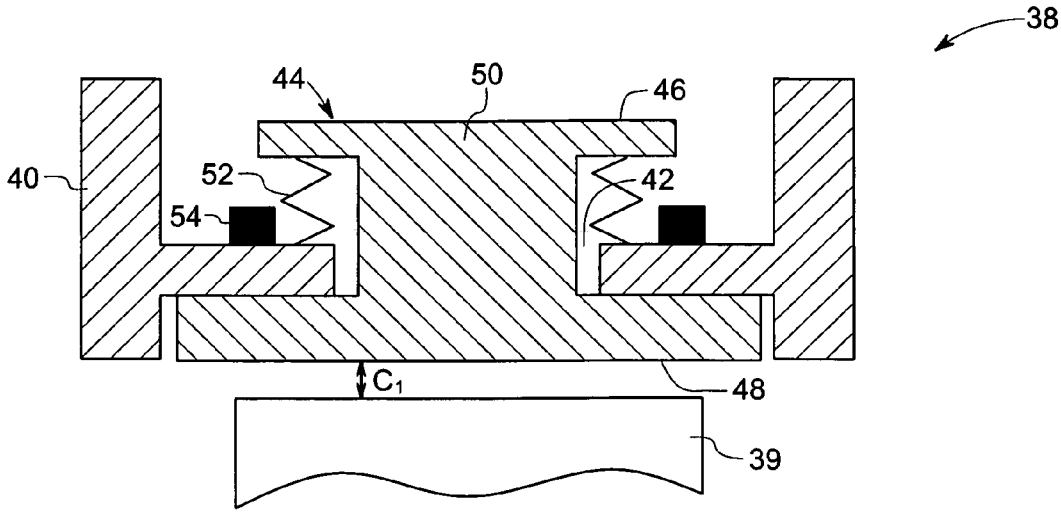
FIG. 2 is a cross sectional schematic view illustrating the configuration of a system including a compliant seal assembly in the absence of fluid back pressure.
Figure 3:
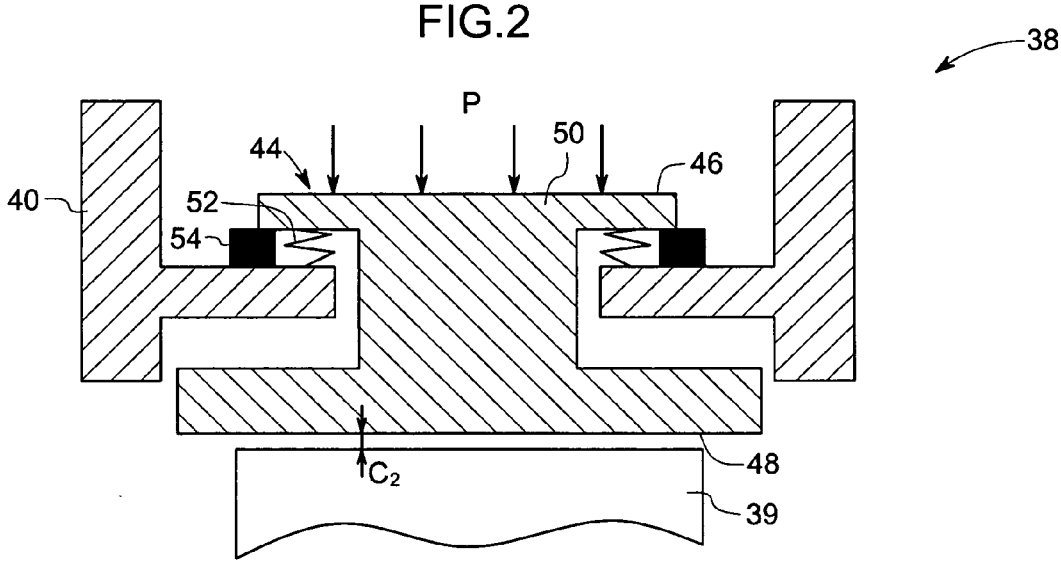
FIG. 3 is a cross sectional schematic view illustrating the configuration of a system including a compliant seal assembly exposed to fluid back pressure.
Figure 4:
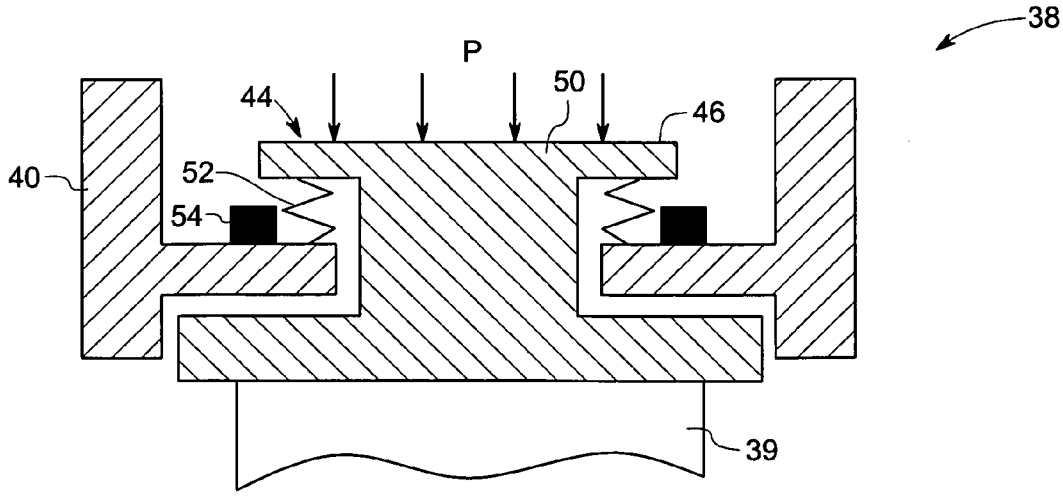
FIG. 4 is a cross sectional schematic view illustrating the configuration of a compliant seal assembly exposed to fluid back pressure, during rub or contact between the movable member and the rotating member.

Referring generally to FIGS. 2–4, a compliant sealing mechanism is schematically illustrated for a system 38, which may comprise a rotating machine, such as a turbine, having a rotating member 39, such as a blade. The system 38 includes a static member 40 having a slot 42. A movable member 44 is mounted on the static member 40. The movable member 44 has a rear surface 46, a sealing surface 48, and an extension 50, which extends through the slot 42 of the static member 40. The movable member 44 is supported on the static member 40 by a biasing member 52. An example of a biasing member is a spring, such as a leaf spring, or a cantilever spring, as described hereinafter. The biasing member is configured to urge the movable member away from the rotating member 39. This may be achieved by preloading the biasing member 52 at the time of assembly. The biasing member 40 may also be adapted to provide mechanical stability to the movable member 44 during steady state operation of the machine.

FIG. 2 illustrates a configuration of the system 38 at a no-load condition when there is a relatively small fluid pressure applied on the rear surface 46 of the movable member 44. An example of such a condition is during start-up of the rotating machine. Under such a condition, a clearance $C_1$ exists between the sealing surface 48 of the movable member 44 and the rotating member 39.

FIG. 3 illustrates a configuration of the system 38 when a fluid pressure P is applied on the rear surface 46 of the movable member 44. In case of a turbine, as described earlier, the fluid pressure at full load is provided by a cooling gas via an opening in the stationary housing. The fluid pressure P on the rear surface 46 urges the sealing surface 48 radially inward, toward a sealing position with the rotating member 39. A hard stop 54 may be provided to limit the radially inward fluid pressure activated motion of the movable member 44. Under such a condition, a clearance $C_2$ between the sealing surface 48 of the movable member 44 and the rotating member is significantly less then the clearance $C_1$ at no load as illustrated in FIG. 2. The fluid pressure P thus reduces leakage of the working fluid between the static and rotating components, and hence increases useful work done by the working fluid on the rotating member 39. The biasing member 52 is configured to urge the movable member 44 radially outward, away from the sealing position with the rotating member 39, against the force exerted by the fluid pressure.

FIG. 4 illustrates a configuration of the system 38 during a rub, contact or interference of the rotating member 39, with the movable member 44. Such a condition may arise during a thermal transient period, wherein there is a dissimilar thermal growth between static and rotating components. Under such a condition, the contact force or reaction on the rotating member 39 and the movable member 44 is significantly reduced by the biasing member 52, which exerts a radially outward force on the movable member 44, to urge the sealing surface 48 of the movable member 44 away from the rotating member 39. This causes the rub or contact to be less severe, which reduces wear on the interfacing surfaces, thus increasing the life of rotating and static components of rotating machines. The reduction of contact force also leads to significantly lower vibration levels in such machines.

Figure 5:
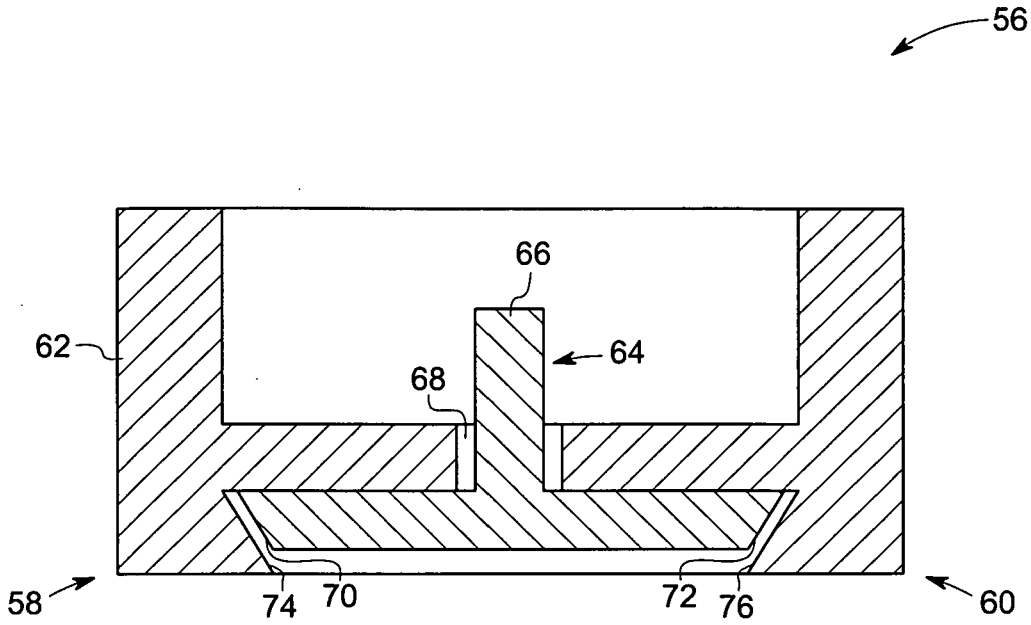
FIG. 5 is a cross sectional view illustrating a compliant seal assembly having beveled edges at the fore and aft ends, in accordance with aspects of the present techniques, when biasing effect of the biasing member is greater than the fluid back pressure.
Figure 6:
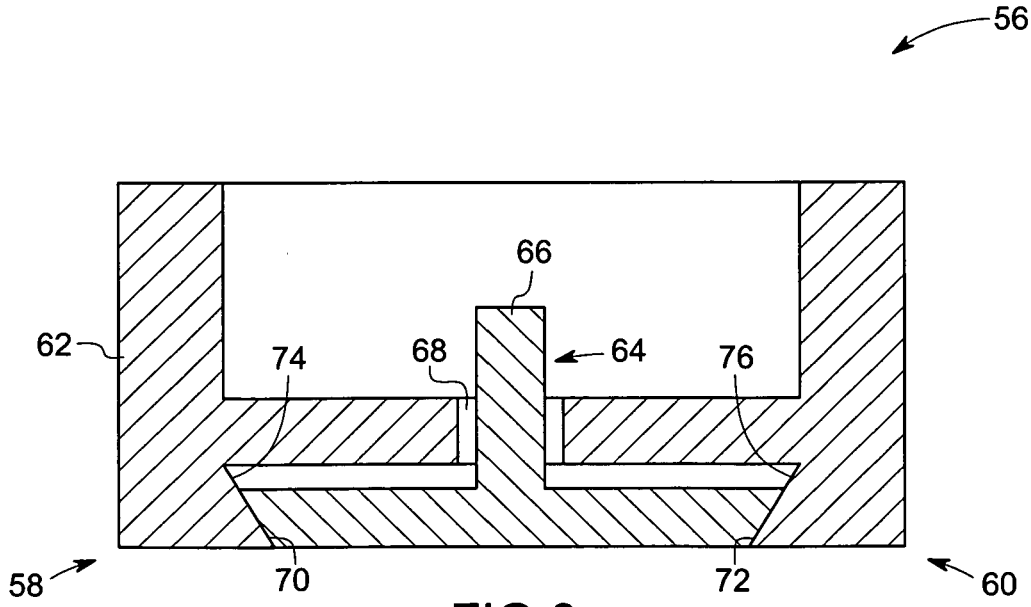
FIG. 6 is a cross sectional view illustrating a a compliant seal assembly having beveled edges at the fore and aft ends, in accordance with aspects of the present techniques, when biasing effect of the biasing member is less than the fluid back pressure.

Referring generally to FIGS. 5 and 6, a cross-section of a compliant seal assembly 56 in accordance with aspects of the present techniques is illustrated. FIG. 5 shows the configuration of the compliant seal assembly 56 when biasing effect of the biasing member is greater than the fluid back pressure. The fore end and the aft end of the seal assembly 56 are represented generally by the numerals 58 and 60 respectively. The seal assembly includes a static member 62 and a movable member 64 having an extension 66, which is inserted through a window-like slot 68 in the static member 62. The movable member 64 includes beveled surfaces 70 and 72, aligned with corresponding beveled surfaces 74 and 76 of the static portion, extending along an are length of the seal assembly perpendicular to the plane of the figures, along the fore and aft ends respectively. As will be appreciated by those skilled in the art, while beveled surfaces are provided in the illustrated embodiment, other profiles of sealing surfaces may, of course, be envisaged.

The above arrangement is advantageous in several ways. The beveled surfaces 70, 74 and 72, 76 provide a natural sealing between the static member 62 and the movable member 64 at the fore and aft ends. This sealing surface provides sufficient back pressure to purge the cavities of the compliant shroud assembly. This also reduces hot gas ingestion into the cooling gas in case of a negative pressure differential between the hot gas and the cooling gas. Further, the beveled surfaces provide a natural hard stop to limit the radially inward motion of the movable member caused by the fluid pressure when biasing effect of the biasing member is less than the fluid back pressure, as shown in FIG. 6. This prevents damage to the movable member and the rotating blades in case of a failure of the biasing member (not shown). As can be appreciated, the above arrangement further provides mechanical support to the movable member 64, which reduces vibration of the movable member 64, thus providing mechanical stability during steady state conditions.

Figure 7:
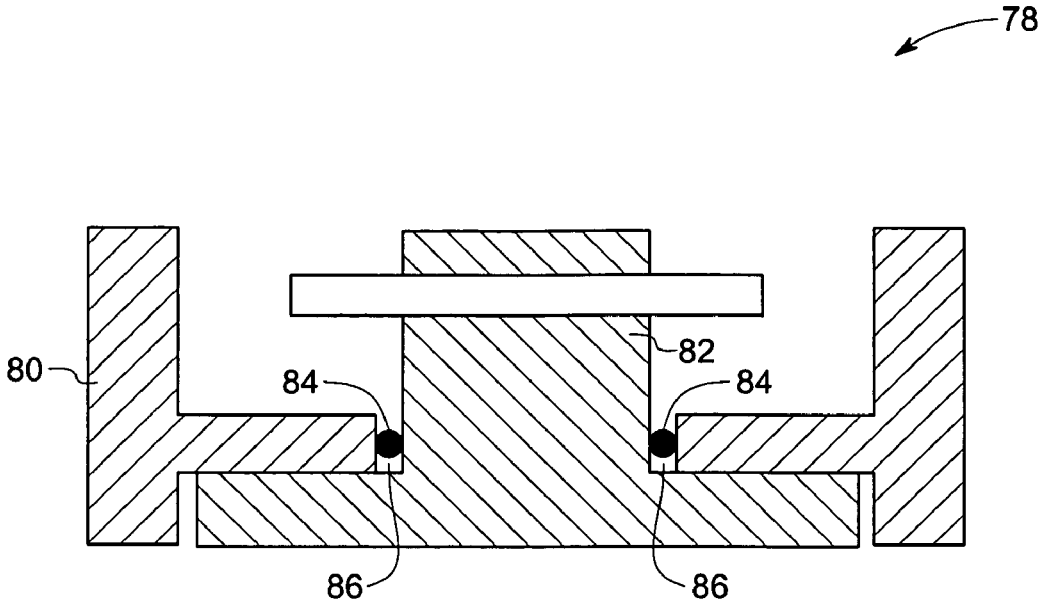
FIG. 7 is a cross sectional view of a compliant seal assembly having a rope seal engaged between the retaining extension and the static member.
Figure 8:
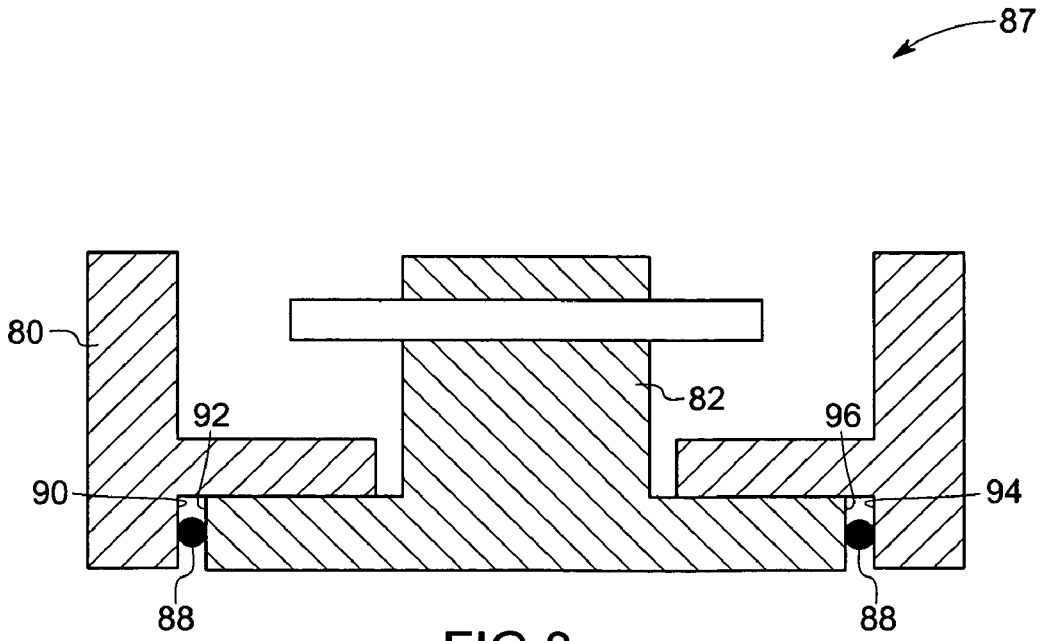
FIG. 8 is a cross sectional view of a compliant seal assembly having a rope seal engaged between the compliant member and the static member at the fore and aft ends of the seal assembly.

FIG. 7 illustrates a cross section of a compliant seal assembly 78 according to another embodiment of the present techniques. In this case, sealing between static member 80 and movable member 82 is provided by rope seals 84, which are engaged between the static and the movable member at slot 86. The rope seals 84 extend along the length of the slot 86 in a circumferential direction (perpendicular to the plane of the figure), providing sufficient back pressure to purge the cavities of the compliant shroud assembly and preventing hot gas ingestion into the cooling gas through the slot 86. Yet another approach for sealing at the fore and aft ends is illustrated in FIG. 8 for compliant seal assembly 87. Here, rope seals 88 are engaged between surfaces 90 and 92 and between surfaces 94 and 96 of the static member 80 and the movable member 82 respectively. Again, other types and configurations of seals may be employed in place of the rope seals shown.

The various embodiments of the compliant seal assembly described earlier may form a complete ring, or a segment of a ring. However, rotating machines, such as turbines may generally comprise multiple segments of the compliant seal assembly positioned circumferentially adjacent to each other. Each segment has two end faces, which interface with corresponding end faces of the adjacent segments. As will be appreciated hereinafter, aspects of the present techniques can be used to provide static sealing at the end faces of the compliant seal assembly, and also to minimize interference of the rotating blades at the interface between two adjacent compliant seal assembly segments.

Figure 9:
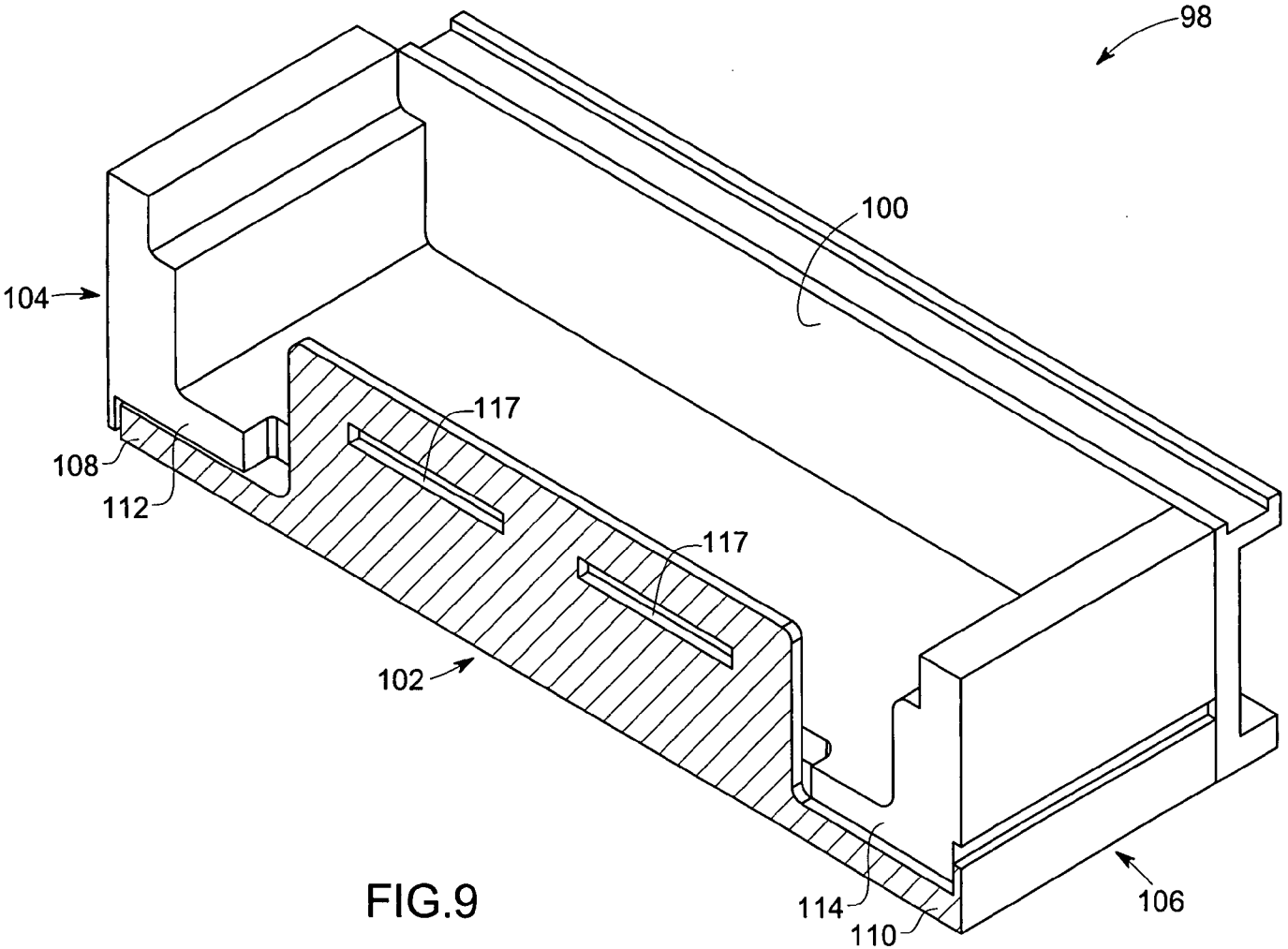
FIG. 9 is a perspective view showing a cut section along a segment of a compliant seal assembly having a double lip seal at the end faces of the compliant seal assembly.

FIG. 9 illustrates a segment of a compliant seal assembly 98 having a static member 100 and a movable member 102. The figure shows a cut section the movable member 102 as viewed from the fore end in the direction of the aft end of the seal assembly 98. End faces of the compliant seal assembly 98 are represented by the reference numerals 104 and 106. The movable member has protruding structures or lips 108 and 110, which overlap with corresponding lips 112 and 114, respectively, provided on the static member 100. This provides a seal between the static member 100 and the movable member 102 at the end faces, and prevents leakage of the cooling fluid through the end faces. The above described arrangement is also referred to as a double lip seal arrangement. Further, in one embodiment, slots 117 may be provided in the movable member 102 for insertion of a biasing member (not shown) to urge the movable member 102 from a sealing position.

Figure 10:
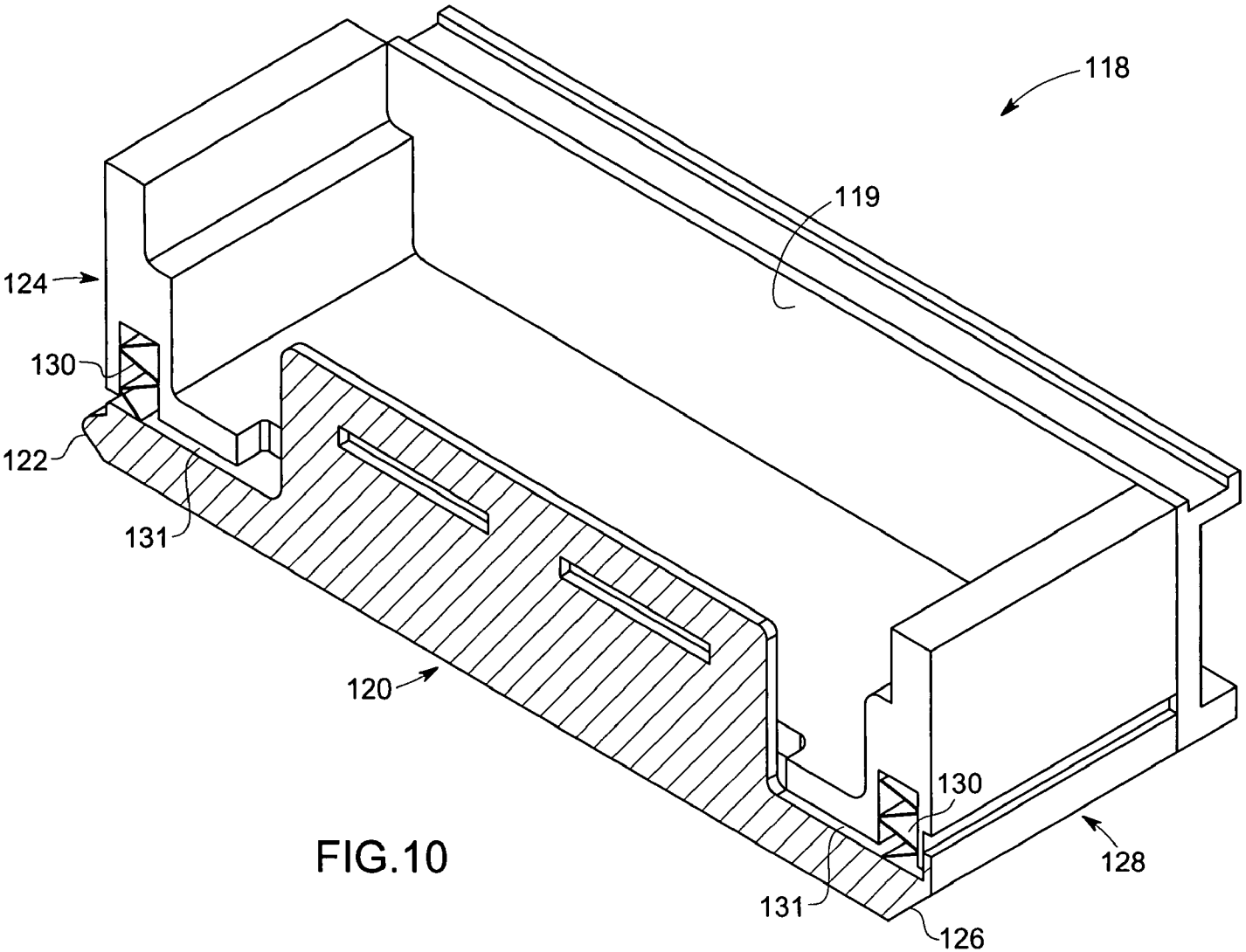
FIG. 10 is a perspective view showing a cut section along a segment of a compliant seal assembly, having a W-seal engaged between the static and the movable members at the end faces of the seal assembly.
Figure 11:
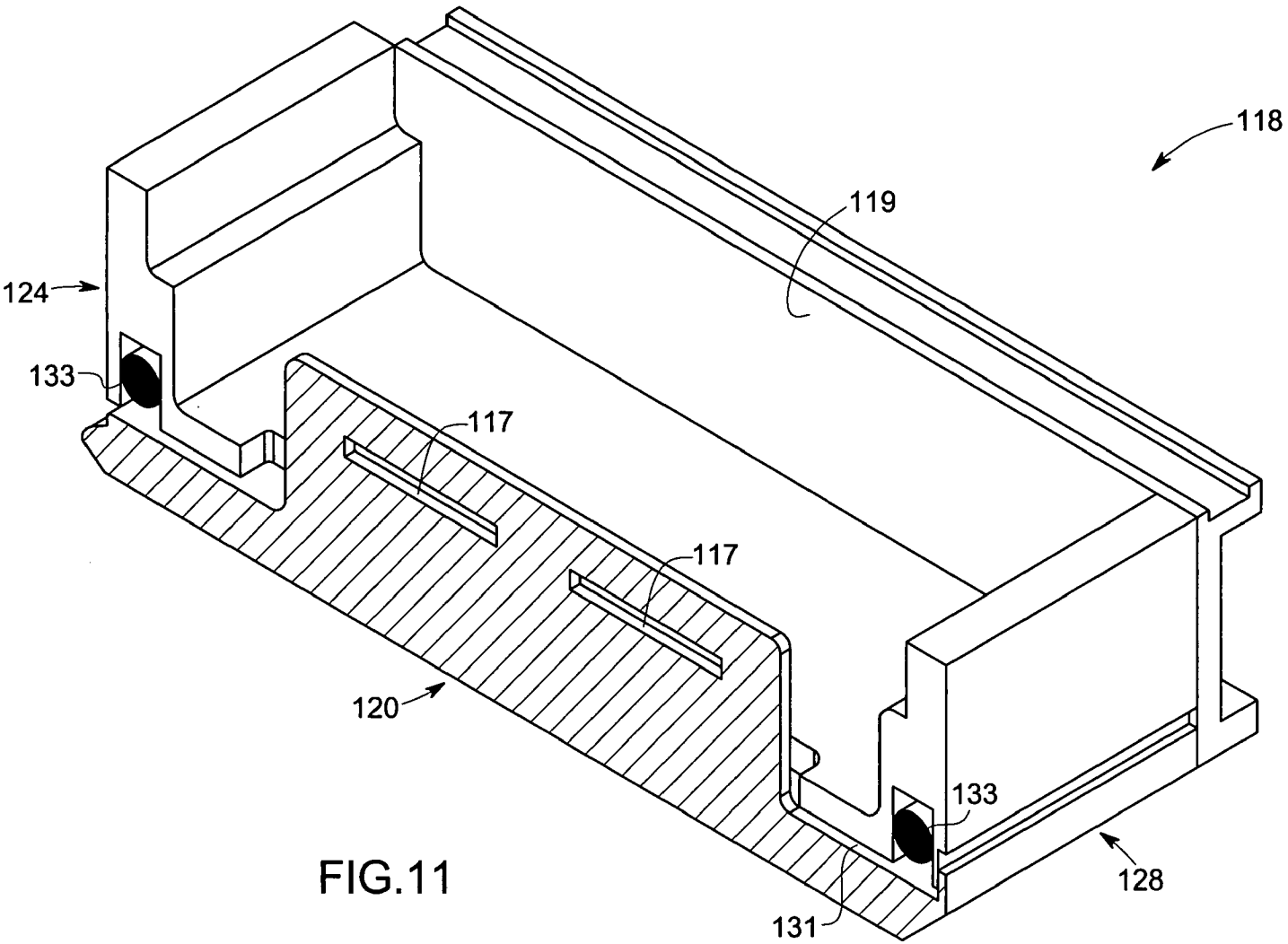
FIG. 11 is a perspective view showing a cut section along a segment of a compliant seal assembly, having a rope engaged between the static and the movable members at the end faces of the seal assembly.

FIG. 10 illustrates another approach for end face sealing. In this embodiment, a seal assembly segment 118 comprises a static member 119 and a movable member 120 having a chamfer 126 at end face 128, and a protrusion 122 at end face 124, such that the chamfer of one segment interfaces with a protrusion of an adjacent segment, thus providing effective cascading of adjacently positioned compliant seal segments. This reduces interference by rotating blades at the interfacing sections between adjacent segments. Interface seals 130 are engaged between the movable member 120 and the static member 119 at the two end faces 124 and 128, to provide adequate back pressure to purge the opening 131. In this embodiment, the interface seals 130 have a W-shaped cross section. In a different embodiment, rope seals 133 may be used in place of W-shaped seals, as illustrated in FIG. 11. Again, other seal configurations may be used in place of these.

Figure 12:
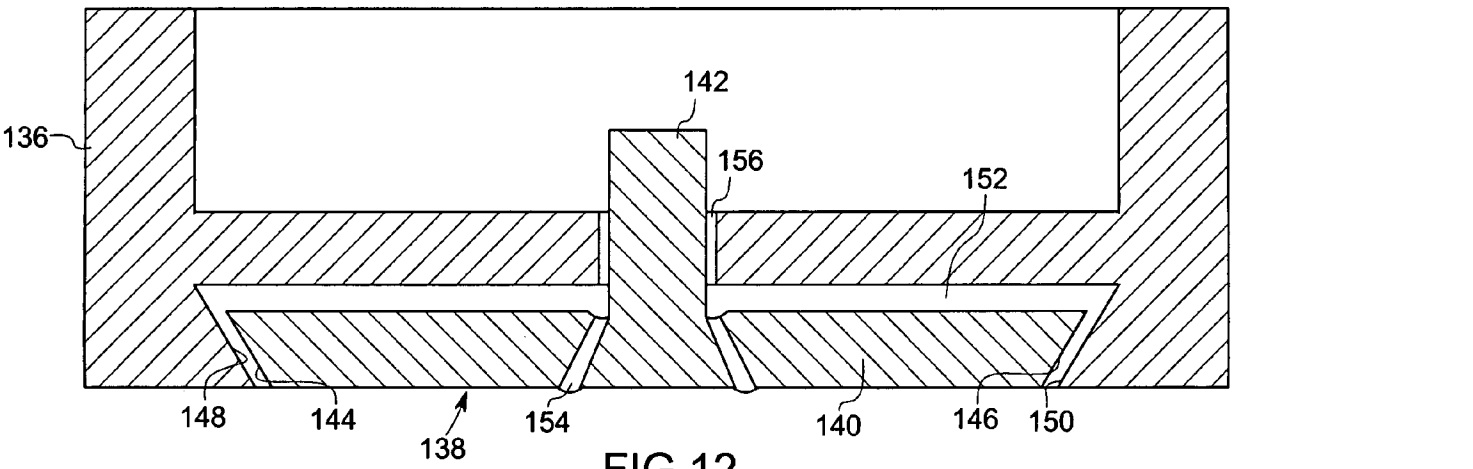
FIG. 12 is a cross sectional schematic view of a compliant seal, assembled in accordance with one embodiment of the present techniques.

Aspects of the present techniques also provide for manufacturing and assembly of a compliant seal. FIG. 12 illustrates the manufacture and assembly of a compliant seal 134 according to one embodiment of the present techniques. In the illustrated embodiment, the compliant seal 134 comprises a static member 136 and a movable member 138 having a base 140 and a rib or a retaining extension 142. The base 140 has beveled surfaces 144 and 146, which are adapted to be aligned with beveled surfaces 148 and 150 provided on the static member 136. In this embodiment, the base 140 and the rib 142 are manufactured separately. The base 140 is inserted from an end face into a cavity 152 on the static member formed by the beveled surfaces 148 and 150 on the static member 136, such that the beveled surfaces 144 and 146 on the base 140 align with beveled surfaces 148 and 150 on the static member 136. The rib 142 is then inserted from the bottom into a slot 154 provided on the base 140, and extended through the static member 136 through a slot 156 on the static member 136. The rib 142 is then fixedly joined to the base 140. In an exemplary embodiment, this is achieved by brazing the rib 142 on to the base 140. Other techniques for fixing these parts together may, of course, be used. As illustrated in the figure, the lower portion of the rib 142 is angled outwards. This configuration advantageously creates a compressive force on the brazed joint during contact of the movable member 138 with the rotating blades, thus providing structural strength to the brazed joint.

Figure 13:
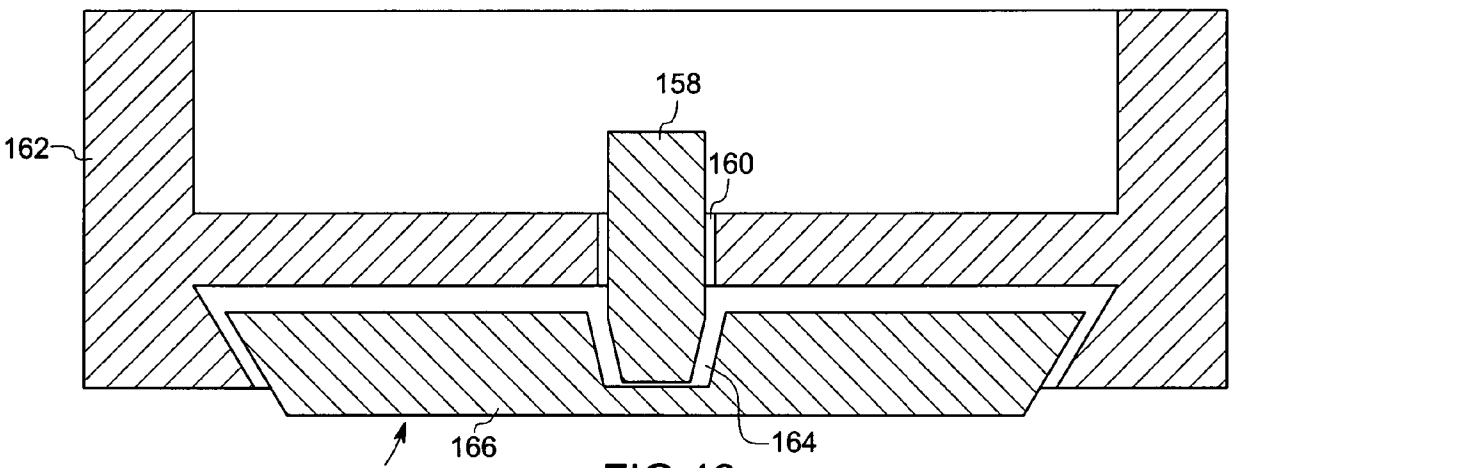
FIG. 13 is a cross sectional schematic view of a compliant seal, assembled in accordance with another embodiment of the present techniques.

FIG. 13 illustrates an alternative technique for manufacturing and assembling a compliant seal 157. In this embodiment, the rib 158 is inserted from the top via a slot 160 provided on the static member 162, into a cavity 164 on the base 166 of the movable member 168. Unlike in the earlier embodiment, the rib 158 does not extend through the base 166. This technique thus advantageously provides a continuous interfacing surface of the base 166 with the rotating blades during a rub or contact, thereby minimizing interference and vibration.

Figure 14:
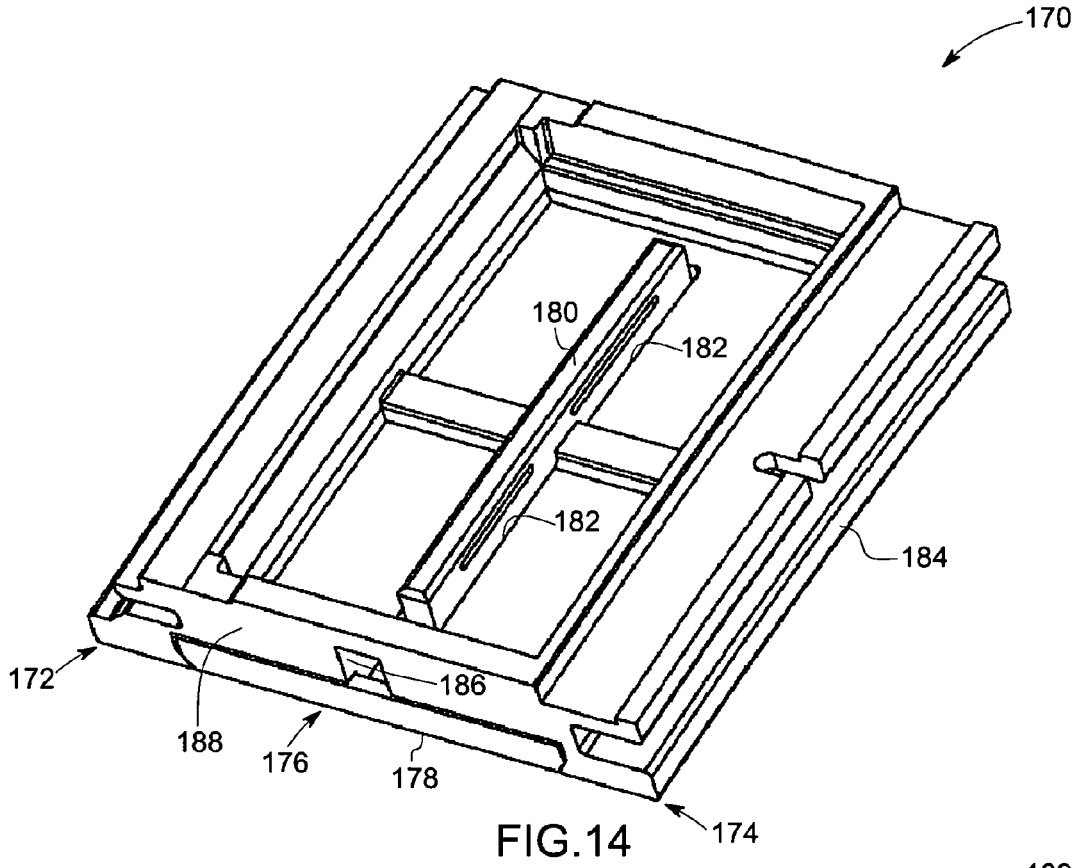
FIG. 14 is a perspective view of a compliant seal, assembled in accordance with yet another embodiment of the present techniques, wherein the movable member is slidably fitted on to the static member through an opening in the static member via a window on the end face.
Figure 15:
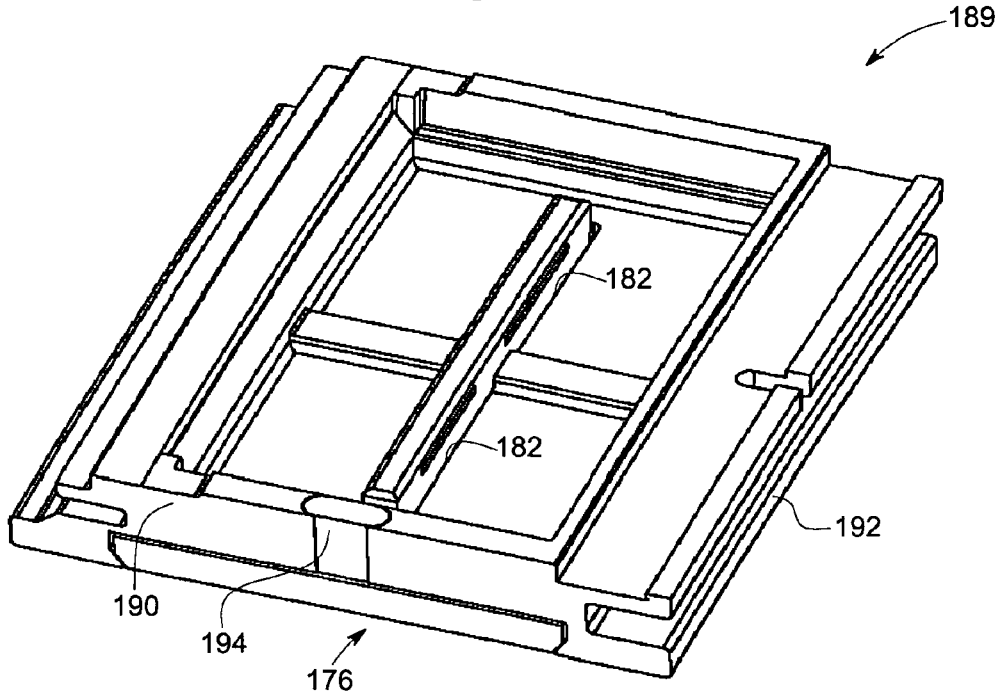
FIG. 15 is a perspective view of a compliant seal, assembled in accordance with yet another embodiment of the present techniques, wherein the movable member is slidably fitted on to the static member through an opening in the static member via a cut on the end face.

In still further embodiments, the movable member is manufactured in a single piece, i.e. the rib or retaining extension is integral to the movable member. FIG. 14 illustrates a segment of a compliant seal 170 in which the fore and aft ends are represented by numerals 172 and 174, respectively. In this embodiment, the movable member 176 is manufactured as a single unit having a base 178 and a rib or retaining extension 180. The movable member 176 is inserted into a slot 182 in the static member 184 via a window or opening 186 provided on one end face 188 of the static member 184. After assembly, the window 186 may be plugged and then sealed by brazing or staking to prevent superfluous leakage. Alternatively, as shown for the compliant seal 189 in FIG. 15, instead of providing an opening along a portion of the height of the end face 190 of the static member 192, a cut or opening 194 may be provided along the entire height of the end face 190. The movable member 176 is then slid into the slot 182 through the opening 194, which is then plugged and sealed by brazing, staking, or any other suitable operation.

In accordance with the present techniques, the compliant seal is provided with a biasing member, which is generally preloaded at the time of assembly, to bias the movable member away from a sealing position with the rotating blades, to reduce the force on the blades and on the movable member during contact or rub of blades with the movable member. However, the arrangements proposed employ gas pressure, already present in the machine in the embodiments shown, to urge the seals towards their sealing position. Due to the differential pressure across the sealing assemblies, then, the sealing position is maintained, while allowing for compliance of the sealing assemblies with the rotating components by virtue of the movement of the movable members, and the aid of the biasing members.

Figure 16:
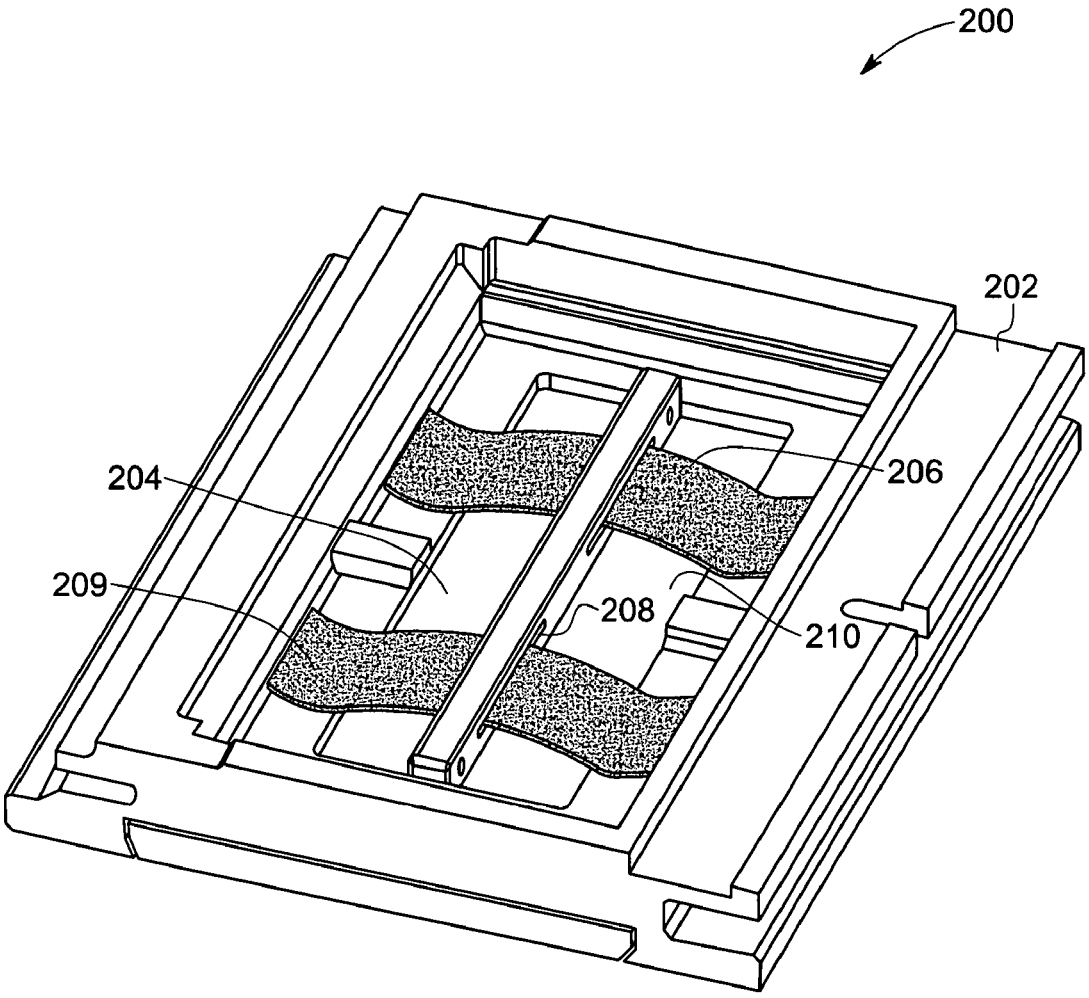
FIG. 16 is a perspective view of a compliant seal assembly having a leaf spring as the biasing member according to one embodiment of the present techniques.

FIG. 16 illustrates a compliant seal 200 having a static member 202, a movable member 204 and one or more biasing members 206, which in the illustrated embodiment are leaf springs, also referred to as cockle springs. In one embodiment, the leaf springs 206 are inserted through slots 208 provided on the movable member 204, and fixed to the static member 202 at the ends 209, to support the movable member 204 on the static member 202. At the time of assembly, the leaf springs are preloaded by compression to exert a radially outward force on the movable member 204, which reduces contact load on the movable member 204 during contact or rub with the blades. Advantageously, in the illustrated embodiment, rear surface 210 of the movable member 204 presents a relatively large surface for exposure to a fluid pressure, thus effectively urging the compliant seal towards rotating blades.

Figure 17:
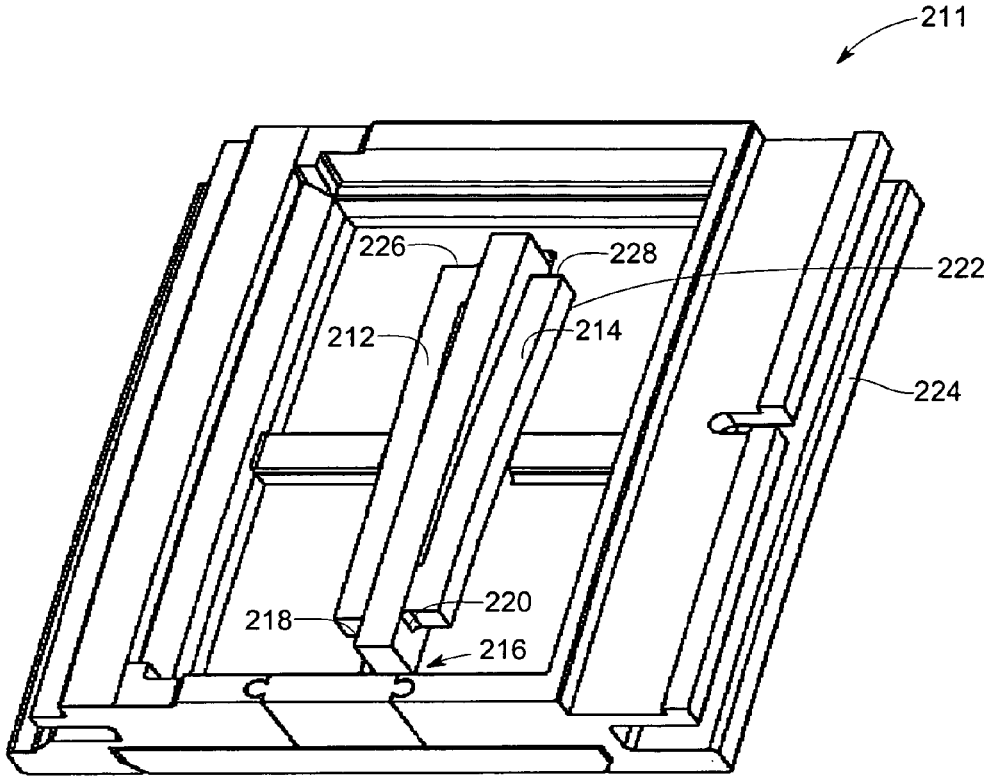
FIG. 17 is a perspective view of a compliant seal assembly having a cantilever spring as the biasing member.
Figure 18:
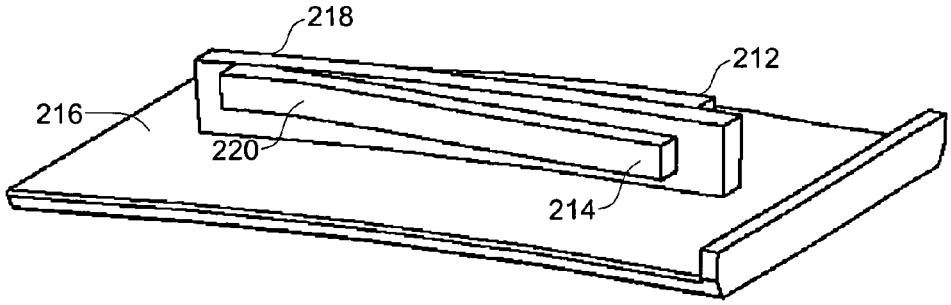
FIG. 18 is a perspective view of the movable member of FIG. 17 having cantilever blocks integral to it.

FIG. 17 illustrates a compliant seal 211 incorporating an alternative biasing technique using cantilever springs as biasing members. In this embodiment, the blocks 212 and 214 are integral to and may be cast together with the movable member 216, separately illustrated in FIG. 18. Blocks 212 and 214 are integrally fixed to the movable member 216 at ends 218 and 220, and interface with an inner surface 222 of static member 224 at ends 226 and 228 at the time of assembly, such that the blocks 212 and 214 are preloaded by their angular position, which may result from bending. This causes the blocks 212 and 214 to function as cantilevers which bias the movable member 216 radially outward, away from a sealing position with the rotating blades, thus reducing contact load on the movable member 216 during contact or rub with the blades.

As noted above, the present techniques may be employed on new machines (i.e. in their original design), or may be retrofit to existing equipment. Because conventional turbines typically include some sort of hanger profile for seals, the compliant seal assemblies may be designed to fit and interface with such hangers in place of conventional seals. The conventional seals may thus be removed, such as during regular or special servicing of the machine, and replaced with the compliant structures provided by the present techniques.

The above described sealing techniques thus provide effective sealing against hot gas leakage at the fore and aft ends, as well as at the end faces, while also providing improved mechanical strength and stability of the seal. This, in turn leads to higher work efficiency and increased life of the seal and the rotating blades. An important feature of the present techniques is that they can be used turbine stages where the rotor blades may be shrouded or unshrouded. Further, as noted above, the various embodiments of the compliant seal described herein are retrofitable, i.e. they can be used in existing machines with minimum changes to the existing design, and minimum number of new parts.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A seal assembly for a rotating machine, comprising:

a static member adapted to be rigidly fixed to the rotating machine between a fore end and an aft end of the rotating machine;

a movable member mounted on the static member, the movable member further comprising:

a sealing surface configured to seal against a rotating member in a sealing position;

a rear surface adapted to be exposed to a fluid pressure to urge the first sealing surface toward the sealing position; and sealing surfaces along fore, aft and end faces of the movable member adapted to interface with sealing surfaces along fore, aft and end faces of the static member, to seal between the static member and the movable member at the fore, aft and end faces of the static member and the movable member; and a biasing member configured to support the movable member on the static member and to urge the movable member away from the sealing position.

2. The seal assembly of claim 1, wherein the movable member further comprises a retaining extension extending through a slot in the static member.

3. The seal assembly of claim 1, wherein the biasing member comprises a leaf spring.

4. The seal assembly of claim 1, wherein the biasing member comprises a cantilever spring.

5. The seal assembly of claim 1, wherein the sealing surfaces along the fore and aft faces of the movable member comprise beveled surfaces adapted to align with beveled surfaces along the fore and aft faces of the static member.

6. The seal assembly of claim 1, wherein the movable member comprises a lip configured to overlap with a lip provided on the static member at the end face of the static member.

7. A seal assembly for a rotating machine, comprising:

a static member adapted to be rigidly fixed to the rotating machine between a fore end and an aft end of the rotating machine, the static member comprising fore and aft sealing surfaces along the fore and aft ends;

a movable member mounted on the static member, the movable member further comprising:

a sealing surface configured to seal against a rotating member in a sealing position;

a retaining extension extending through the static member through an opening in the static member;

a rear surface adapted to be exposed to a fluid pressure to urge the sealing surface toward the sealing position; and fore, aft and end face sealing surfaces along the fore, aft and end faces adapted to align with fore, aft and end face sealing surfaces on the static member; and a biasing member configured to support the movable member on the static member and to urge the movable member away from the sealing position.

8. The seal assembly of claim 7, wherein the movable member comprises a lip configured to overlap with a lip provided on the static member at the end face of the static member.

9. The seal assembly of claim 7, wherein the biasing member comprises a leaf spring.

10. The seal assembly of claim 7, wherein the biasing member comprises a cantilever spring.

11. The seal assembly of claim 7, wherein the static member comprises a slot at end face of the seal assembly to slidably mount the movable member on the static member.

12. A turbine, comprising:

a rotor having a plurality of blades; and a compliant seal assembly comprising:

a static member adapted to be rigidly fixed to a hanger between a fore end and an aft end of turbine;

a movable member mounted on the static member, the movable member further comprising a first sealing surface configured to seal against tips of the blades, a rear surface adapted to be exposed to a pressure exerted by a gas to urge the first sealing surface toward the tips of the blades, and fore, aft and end face sealing surfaces along fore, aft and end faces of the movable member adapted to interface with sealing surfaces along fore, aft and end faces of the static member; and a biasing member configured to support the movable member on the static member and to urge the movable member away from the sealing position.

13. The turbine of claim 12, wherein the fore and aft sealing surfaces of the movable member comprise beveled surfaces along the fore and aft faces of the movable member adapted to aligned with beveled surfaces on the static member along the fore and aft faces of the static member.

14. The turbine of claim 12, wherein the biasing member comprises a leaf spring.

15. The turbine of claim 12, wherein the biasing member comprises a cantilever spring.

16. The turbine of claim 12, comprising a plurality of adjacently positioned seal assemblies mounted on the hanger, each seal assembly forming a segment of a ring and comprising two end faces to interface with end faces of adjacently positioned seal assemblies.

17. The turbine of claim 16, wherein the movable member of each seal assembly comprises a lip configured to overlap with a lip provided on the static member.

18. A method for manufacturing a seal assembly, comprising:

mounting a movable member on a static member;

aligning fore and aft sealing surfaces of the movable member with fore and aft sealing surfaces on the static member at a fore end and an aft end of the seal assembly;

providing at least one opening on the static member, wherein the opening is configured to expose the movable member to a gas pressure to urge the movable member toward a sealing position; and disposing a biasing member on the movable member to support the movable member on the static member and to urge the movable member away from the sealing position;

wherein the movable member comprises a base and a retaining extension formed integral to each other, and wherein mounting the movable member on the static member comprises:

slidably inserting the movable member via an opening provided in an end face of the static member; and sealingly plugging the opening.

19. A method of sealing a gas path in a turbine, comprising:

rotating a turbine blade;

urging a movable member mounted to a static member toward a tip of the turbine blade via a gas pressure applied to a rear surface of the movable member; wherein sealing surfaces along fore, aft and end faces of the movable member are interfaced with sealing surfaces along fore, aft and end faces of the static member;

supporting the movable member in the static member by a biasing member; and preloading the biasing member to bias the movable member away from the turbine blade against a force resulting from the gas pressure.

20. The method of claim 19, comprising supporting the movable member on the static member via a leaf spring.

21. The method of claim 20, wherein preloading the biasing member comprises radially compressing the leaf spring.

22. The method of claim 19, comprising supporting the movable member on the static member via cantilever spring.

23. The method of claim 22, wherein preloading the biasing member comprises bending the cantilever spring.

24. A method of sealing a gas path in a turbine, comprising:

removing an existing seal from a hanger of a turbine shroud assembly; and disposing a compliant seal on the hanger, the compliant seal comprising:

a movable member configured to seal against a tips turbine blades;

a stationary member having at least one opening for exposing the movable member to a gas pressure to urge the movable member toward the tip of the turbine blades; wherein sealing surfaces along fore, aft and end faces of the movable member are adapted to interface with sealing surfaces along fore, aft and end faces of the stationary member; and a biasing member configured to support the movable member and to urge the movable member away from the tips of the turbine blades to reduce the force on the turbine blades during contact of the turbine blade with the movable member.

25. A method for manufacturing a seal assembly, comprising:

mounting a movable member on a static member;

aligning fore and aft sealing surfaces of the movable member with fore and aft sealing surfaces on the static member at a fore end and an aft end of the seal assembly;

providing at least one opening on the static member, wherein the opening is configured to expose the movable member to a gas pressure to urge the movable member toward a sealing position; and disposing a biasing member on the movable member to support the movable member on the static member and to urge the movable member away from the sealing position;

wherein the movable member comprises a base and a retaining extension formed integral to each other, and wherein mounting the movable member on the static member comprises:

slidably inserting the movable member via an opening provided in an end face of the static member;

sealingly plugging the opening; and wherein disposing the biasing member comprises inserting a leaf spring through a slot provided on the movable member and interfacing ends of the leaf spring with the static member.

* * * * *